US010343441B2

(12) United States Patent
Takahashi et al.

(10) Patent No.: US 10,343,441 B2
(45) Date of Patent: Jul. 9, 2019

(54) BOOK BINDING APPARATUS

(71) Applicant: MAX CO., LTD., Chuo-ku, Tokyo (JP)

(72) Inventors: Toshiyuki Takahashi, Tokyo (JP); Kazuya Igata, Tokyo (JP); Tsuyoshi Tsukada, Tokyo (JP); Takaomi Nakamura, Tokyo (JP); Wataru Seitou, Tokyo (JP)

(73) Assignee: MAX CO., LTD., Tokyo (JP)

( * ) Notice: Subject to any disclaimer, the term of this patent is extended or adjusted under 35 U.S.C. 154(b) by 0 days.

(21) Appl. No.: 15/848,384

(22) Filed: Dec. 20, 2017

(65) Prior Publication Data

US 2018/0178575 A1 Jun. 28, 2018

(30) Foreign Application Priority Data

Dec. 22, 2016 (JP) ..... 2016-250004

(51) Int. Cl.
*B42C 1/12* (2006.01)
*B42C 3/00* (2006.01)
*B42C 19/02* (2006.01)

(52) U.S. Cl.
CPC ..... *B42C 1/12* (2013.01); *B42C 3/00* (2013.01); *B42C 19/02* (2013.01)

(58) Field of Classification Search
CPC ..... B42C 1/12; B42C 3/00; B42C 19/02
USPC ..... 412/9, 16, 33, 34, 38, 39
See application file for complete search history.

(56) References Cited

U.S. PATENT DOCUMENTS

2003/0235484 A1* 12/2003 Aguirre ..... B42C 1/12 412/39
2007/0166130 A1 7/2007 Kurabayashi et al.

FOREIGN PATENT DOCUMENTS

JP 4389798 B2 12/2009
JP 5010526 B2 8/2012

* cited by examiner

*Primary Examiner* — Justin V Lewis
(74) *Attorney, Agent, or Firm* — Rothwell, Figg, Ernst & Manbeck, P.C.

(57) ABSTRACT

A book binding apparatus includes: a first processing section which is configured to perform a first process on a medium; a second processing section which is configured to perform a second process on the medium on which the first processing section has performed the first process; a first discharging section to which the medium on which the first processing section has performed the first process is discharged; and a second discharging section to which the medium on which the first processing section has performed the first process, and on which the second processing section has performed the second process is discharged.

15 Claims, 9 Drawing Sheets

FIG. 6

| PROCESS MODE | DISCHARGE DESTINATION | MAIN CONVEYING PATH IS NORMAL | | MAIN CONVEYING PATH IS ABNORMAL |
|---|---|---|---|---|
| | | BINDING IS ABLE | BINDING IS DISABLE | |
| THROUGH | BFINISHER | ○ | ○ | × |
| | BOOKLET TRAY | × | × | × |
| PUNCHING | BFINISHER | ○ | ○ | × |
| | BOOKLET TRAY | × | × | × |
| BINDING | BFINISHER | × | × | × |
| | BOOKLET TRAY | ○ | × | × |

FIG. 9

| PROCESS MODE | DISCHARGE DESTINATION | MAIN CONVEYING PATH IS NORMAL | | MAIN CONVEYING PATH IS ABNORMAL |
|---|---|---|---|---|
| | | BINDING IS ABLE | BINDING IS DISABLE | |
| THROUGH | BFINISHER | ○ | ○ | × |
| | UPPER TRAY | ○ | ○ | × |
| | BOOKLET TRAY | × | × | × |
| PUNCHING | BFINISHER | ○ | ○ | × |
| | UPPER TRAY | ○ | ○ | × |
| | BOOKLET TRAY | × | × | × |
| BINDING | BFINISHER | × | × | × |
| | UPPER TRAY | × | × | × |
| | BOOKLET TRAY | ○ | × | × |

BOOK BINDING APPARATUS

CROSS-REFERENCE TO RELATED APPLICATION(S)

This application is based upon and claims the benefit of priority from prior Japanese patent application No. 2016-250004, filed on Dec. 22, 2016, the entire contents of which are incorporated herein by reference.

BACKGROUND

The present disclosure relates to a book binding apparatus which performs a first process on media, and which performs a second process on the media that undergo the first process, thereby performing book binding, and more particularly a book binding apparatus which punches holes in a medium, and which binds a plurality of punched media with a binder into a booklet.

A binder for binding commercially available loose-leaf sheets, or sheets which undergo a punching process using punches is available.

A book binding apparatus which uses such a binder, and which is used while being connected to an image forming apparatus is proposed. In a system including such a book binding apparatus, when a configuration is employed in which an apparatus for punching holes in sheets, and that for binding punched sheets with a binder are installed independently from each other, the system becomes bulky.

Therefore, a book binding apparatus is proposed that includes a punching section which punches holes in a sheet, and a binding section on which punched sheets are stacked, and which attaches a binder to the holes of the sheets (for example, see Japanese Patent No. 4,389,798 and Japanese Patent No. 5,010,526).

In a related-art book binding apparatus including a punching section and a binding section, in the case where a process of discharging sheets on which only punching is conducted is to be performed, the sheets are discharged onto a tray that is identical with a tray onto which binder-bound booklets are to be discharged.

When sheets on which only punching is conducted, and binder-bound booklets are mixedly stacked on the same tray, a sorting process requires much trouble. Moreover, the tray must be configured so as to be suitable to both sheets on which only punching is conducted, and which are discharged one by one, and binder-bound booklets.

In an apparatus in which different kinds of processes can be performed, and which has a configuration where media that undergo different kinds of processes are discharged onto the same tray, as described above, there arise problems due to mixed stack of media that are differently processed, and due to discharging in which media that are differently processed are discharged onto the same tray.

SUMMARY

It is an object of the disclosure to provide a bookbinding apparatus in which it is possible to prevent media that are differently processed, from being mixedly stacked.

According to an aspect of the disclosure, there is provided a book binding apparatus comprising: a first processing section which is configured to perform a first process on a medium; a second processing section which is configured to perform a second process on the medium on which the first processing section has performed the first process; a first discharging section to which the medium on which the first processing section has performed the first process is discharged; and a second discharging section to which the medium on which the first processing section has performed the first process, and on which the second processing section has performed the second process is discharged.

BRIEF DESCRIPTION OF THE DRAWINGS

FIG. 6 is a view illustrating the availability of combinations of the process and discharge destination in the book binding apparatus.

FIG. 9 is a view illustrating the availability of combinations of the process and discharge destination in the book binding apparatus of the second embodiment.

DETAILED DESCRIPTION OF EXEMPLARY EMBODIMENTS

Hereinafter, an example of a book binding apparatus of the embodiment will be described with reference to the drawings.

<Configuration Example of Book Binding Apparatus of First Embodiment>

Figure 1:
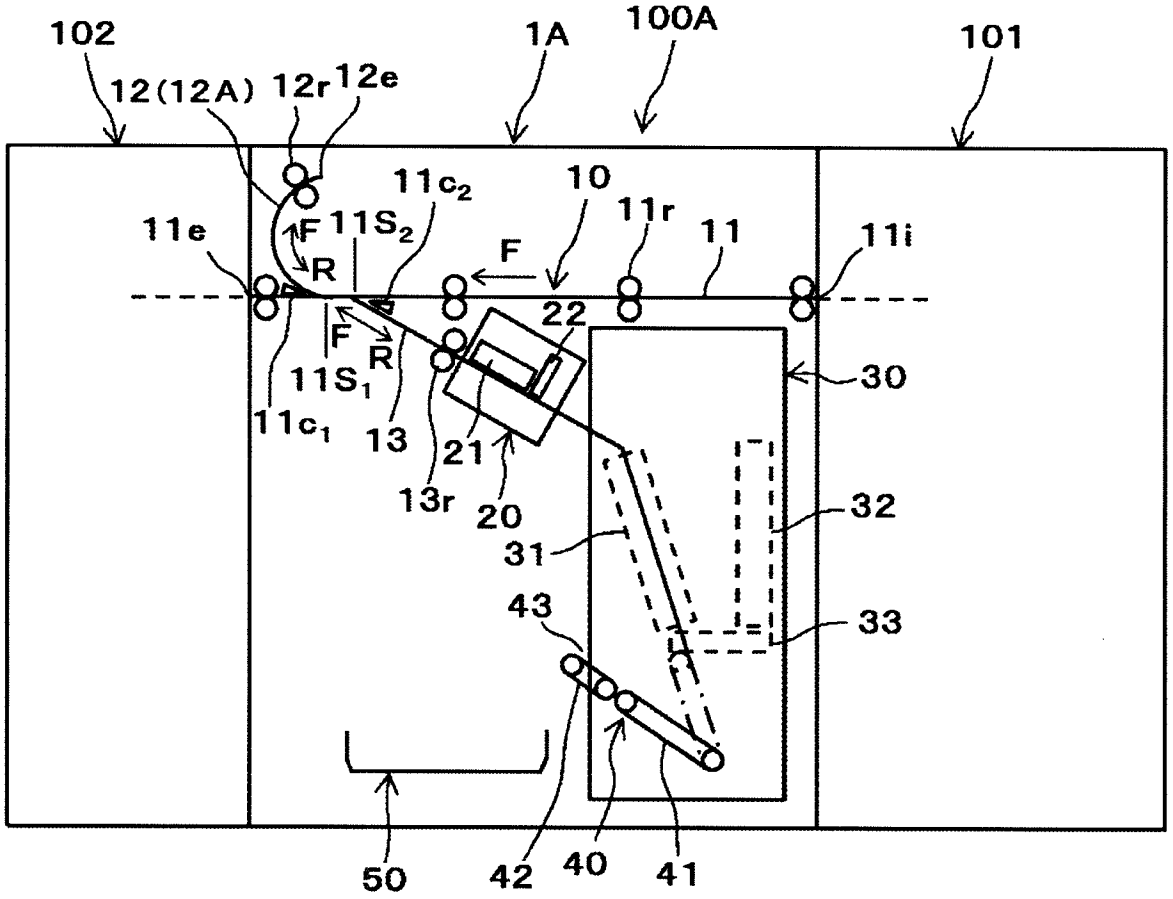
FIG. 1 is a diagram showing an example of a book binding apparatus of a first embodiment.
Figure 2A:
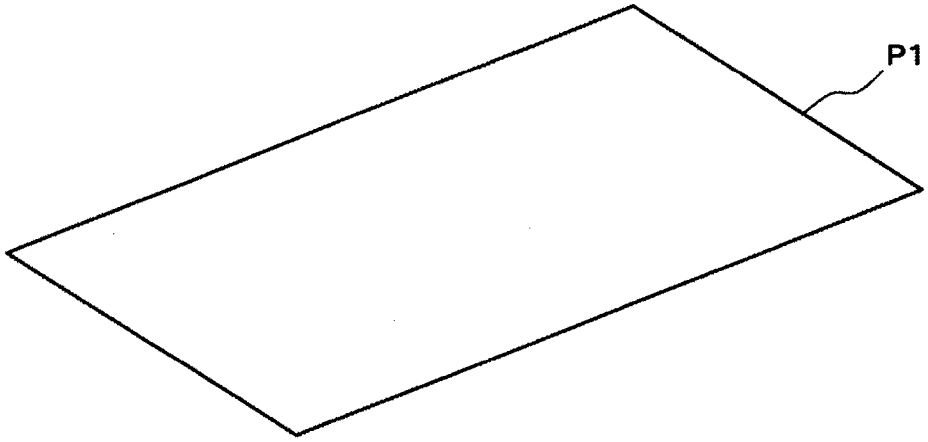
FIGS. 2A and 2B are views illustrating an example of a process which is performed on a sheet.
Figure 2B:
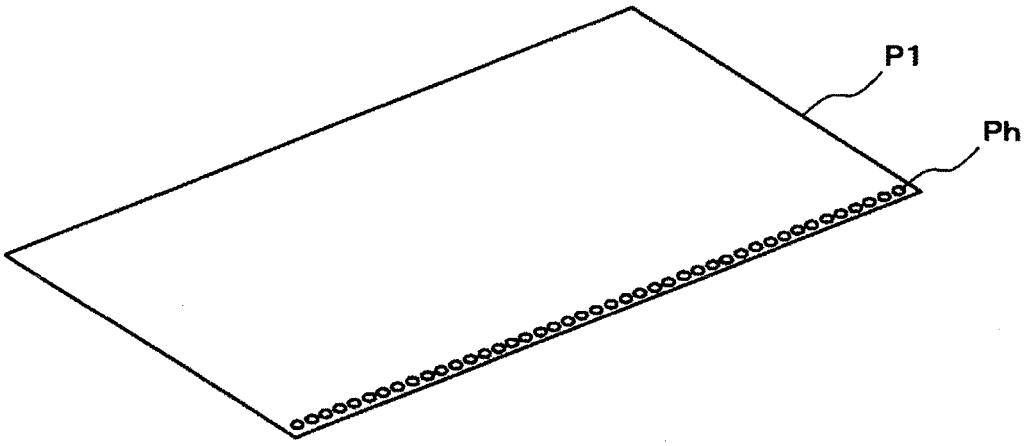
Figure 3A:
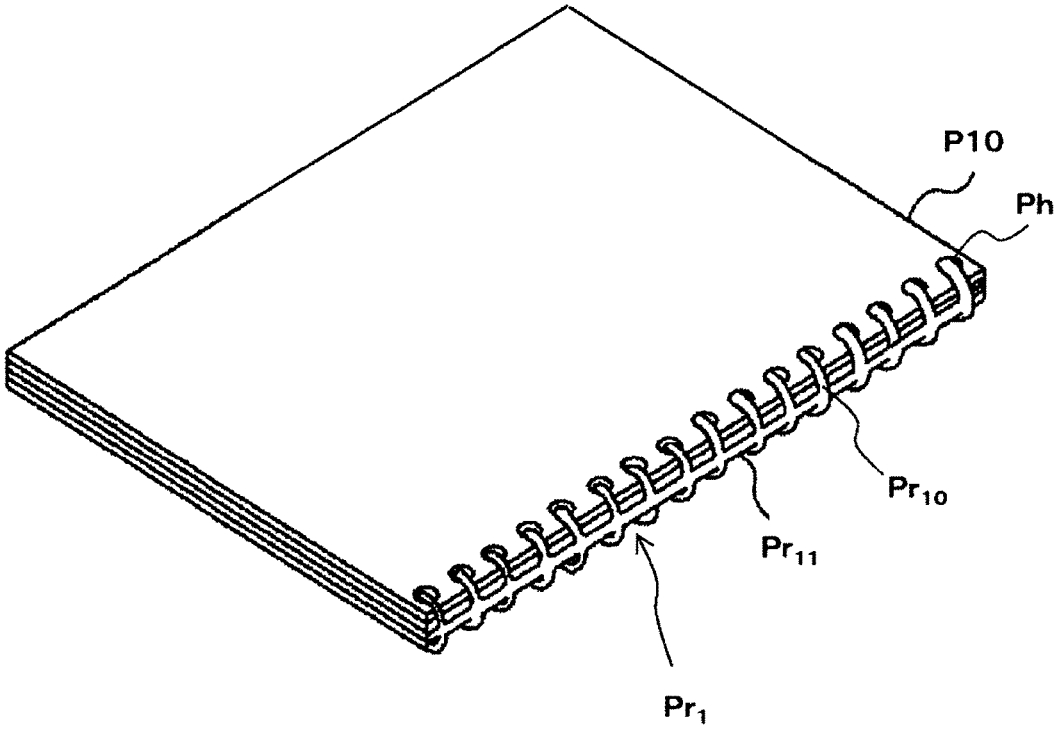
FIGS. 3A and 3B are views illustrating an example of a booklet which is bound with a binder.
Figure 3B:
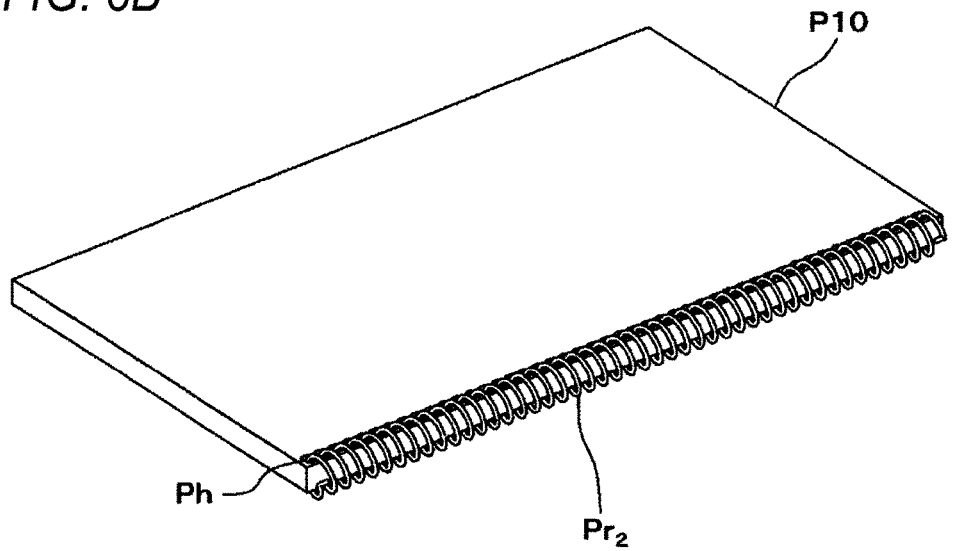

FIG. 1 is a diagram showing an example of a book binding apparatus of a first embodiment, FIGS. 2A and 2B are views illustrating an example of a process which is performed on a sheet, and FIGS. 3A and 3B are views illustrating an example of a booklet which is bound with a binder.

Processes which are performed in the book binding apparatus 1A of the first embodiment will be summarily described. The book binding apparatus 1A punches a plurality of holes Ph in a sheet P1 shown in FIG. 2A in a predetermined arrangement as shown in FIG. 2B, in the example, a plurality of holes Ph in one row and at a predetermined number and regular intervals. The book binding apparatus 1A stacks sheets P1 in which the holes Ph are punched, to form a sheet bundle in which the positions of the holes Ph are aligned with one another, and binds the bundle with a binder Pr ($Pr_1$, $Pr_2$) as shown in FIGS. 3A and 3B, thereby forming a booklet P10.

The binder $Pr_1$ shown in FIG. 3A includes a plurality of ring portions $Pr_{10}$ which have an annular shape, and which can be opened and closed, and a back portion $Pr_{11}$ which couples the ring portions $Pr_{10}$ together. In a state where the ring portions $Pr_{10}$ are opened, the binder can be inserted through the holes Ph of the sheets P1, and, when the ring portions $Pr_{10}$ are closed, the bundle of the sheets P1 is bound. The binder $Pr_2$ shown in FIG. 3B is in a form where a resin or metal wire is spirally wound. The form of the binder is not limited to the forms of the binders $Pr_1$, $Pr_2$. The disclosure is applicable to any form of a binder as far as bounding is performed while at least a part of the binder is inserted through the holes Ph of the sheets P1.

The book binding apparatus 1A which performs the above-described process will be summarily described. The book binding apparatus 1A includes a sheet conveying path 10 which conveys a sheet P1 that is an example of the media, and a punching section (a first processing section) 20 which punches the holes Ph in the sheet P1 in a predetermined arrangement. The book binding apparatus 1A further includes: a binding section (a second processing section) 30 that binds the sheets P1 in which the holes Ph are punched by the punching section 20, with the binder Pr; a booklet conveying path 40 which conveys the booklet P10 that is an example of the media bound in the binding section 30; and a booklet tray (a second discharging section) 50 onto which the booklet P10 conveyed through the booklet conveying path 40 is discharged.

The book binding apparatus 1A is used while being incorporated into a book binding system 100A. In the book binding system 100A in the embodiment, an upstream machine 101 such as an image forming apparatus is connected to the upstream side of the book binding apparatus 1A, and a downstream machine (a first discharging section) 102 such as a sorting apparatus which is called a finisher is connected to the downstream side. The downstream machine 102 functions as an example of the first discharging section.

Next, the book binding apparatus 1A will be described in detail. The sheet conveying path 10 includes: a main conveying path 11 which conveys the sheet P1 output from the upstream machine 101; a reverse conveying path (a curved conveying path) 12 which branches from the main conveying path 11 in a branch portion 11$S_1$, and which reverses the conveying direction of the sheet P1; and a sub-conveying path 13 which branches from the main conveying path 11 in a branch portion 11$S_2$, and which conveys the sheet P1 the conveying direction of which is reversed in the reverse conveying path 12, to the punching section 20.

The main conveying path 11 is placed in the upper portion of the interior of the book binding apparatus 1A, and configures a linear conveying passage which is approximately horizontal, and which conveys the sheet P1 between a sheet feeding port 11*i* that is connected to a discharging port (not shown) of the upstream machine 101, and a sheet discharging port lie that is connected to a sheet feeding port (not shown) of the downstream machine 102.

The main conveying path 11 includes a plurality of conveying rollers 11*r* which are placed in a plurality of places that are arranged along the direction of conveying the sheet P1, respectively, and guiding members and the like which are not shown. Each of the conveying rollers 11*r* is configured by a pair of rollers, i.e., a driving roller which receives a driving force of a motor to be rotated, and a driven roller which is opposed to the driving roller.

The reverse conveying path 12 configures a curved conveying passage which upward branches from the main conveying path 11 in the branch portion 11$S_1$, and which is bent toward the side that is opposite to the conveying direction indicated by the arrow F. The reverse conveying path 12 includes a plurality of conveying rollers 12*r* which are placed in a plurality of places that are arranged along the direction of conveying the sheet P1, respectively, and guiding members and the like which are not shown. Each of the conveying rollers 12*r* is configured by a pair of rollers, i.e., a driving roller which receives a driving force of a motor to be rotated, and a driven roller which is opposed to the driving roller. Alternatively, the reverse conveying path 12 may be configured so as to branch in the branch portion 11$S_1$ toward the side under the main conveying path 11.

The reverse conveying path 12 has a configuration where bi-directional conveyance of the sheet P1 is enabled by controlling the rotation direction of the conveying rollers 12*r*, and conveys the sheet P1 which is conveyed from the main conveying path 11 to the reverse conveying path 12, to the sub-conveying path 13 while reversing the conveying direction.

The sub-conveying path 13 configures a linear conveying passage which downward branches from the main conveying path 11 in the branch portion 11$S_2$, and which is connected to the punching section 20. The sub-conveying path 13 includes a plurality of conveying rollers 13*r* which are placed in a plurality of places that are arranged along the direction of conveying the sheet P1, respectively, and guiding members and the like which are not shown. Each of the conveying rollers 13*r* is configured by a pair of rollers, i.e., a driving roller which receives a driving force of a motor to be rotated, and a driven roller which is opposed to the driving roller.

The sub-conveying path 13 has a configuration where bi-directional conveyance of the sheet P1 is enabled by controlling the rotation direction of the conveying rollers 13*r*, and conveys the sheet P1 in the direction of the arrow R from the punching section 20 to the binding section 30. Moreover, the sub-conveying path 13 reverses the conveying direction of the sheet P1 conveyed to the punching section 20, to the direction of the arrow F, and then conveys the sheet P1 to the main conveying path 11.

In the branch portion 11$S_1$, the conveying passage for conveying the sheet P1 which is conveyed through the main conveying path 11 in the forward direction indicated by the arrow F branches from the main conveying path 11 to the reverse conveying path 12. The branch portion 11$S_1$ includes a switch blade 11$c_1$ which switches the conveying passage for the sheet P1 from the main conveying path 11 to the reverse conveying path 12.

In the branch portion 11$S_2$, the conveying passage for conveying the sheet P1 which is conveyed through the main conveying path 11 and the reverse conveying path 12 in the reverse direction indicated by the arrow R branches from the main conveying path 11 to the sub-conveying path 13. The branch portion 1152 includes a switch blade 11$c_2$ which switches the conveying passage for the sheet P1 from the main conveying path 11 to the sub-conveying path 13.

The sheet conveying path 10 configures a switchback type conveying passage which reverses the conveying direction of the sheet P1 that is conveyed from the main conveying path 11 to the reverse conveying path 12, and which then conveys the sheet to the sub-conveying path 13.

Therefore, the branch portion 11$S_2$ where the passage branches from the main conveying path 11 to the sub-conveying path 13 is disposed on the upstream side of the branch portion 11$S_1$ where the passage branches from the main conveying path 11 to the reverse conveying path 12, in the conveying direction of the sheet P1 which is indicated by the arrow F.

At a timing when the front end of the sheet P1 which is conveyed through the reverse conveying path 12 reaches the terminal position 12*e* of the reverse conveying path 12, moreover, the rear end of the sheet P1 must have passed through the branch portion 11$S_2$.

Therefore, the length of the reverse conveying path 12 is set to be equivalent to or longer than the conveying direction length of the sheet P1 of the maximum size which can be processed in the book binding apparatus 1A. Specifically, the length from the terminal of the reverse conveying path 12 to the branch portion 11$S_2$ is set to be equivalent to or longer than the conveying direction length of the sheet P1.

In order to configure a switchback type conveying passage, the sheet conveying path 10 includes the reverse conveying path 12 which is branched from the main conveying path 11, and does not convey the sheet P1 the conveying direction of which is to be reversed, toward the sheet discharging port 11*e*.

Therefore, the length from the branch portion 11$S_2$ to the sheet discharging port 11*e* is set to be shorter than the conveying direction length of the sheet P1.

The punching section 20 is an example of the first processing section, and includes a positioning portion 21 which aligns the sheet P1, and a punch blade 22 which punches holes in the sheet P1. In the punching section 20, the front end and lateral positions of the sheet P1 which is conveyed through the sub-conveying path 13 are aligned in the positioning portion 21. As shown in FIG. 2B, as the first process, the punching section 20 punches the holes Ph in a predetermined arrangement in the sheet P1 which is aligned in the positioning portion 21, by reciprocating the punch blade 22 in a direction which is approximately perpendicular to the surface of the sheet P1.

The binding section 30 is an example of the second processing section, and includes a sheet registration tray 31 which is placed downstream of the punching section 20, and on which a plurality of sheets P1 in which the holes Ph are punched in the punching section 20 are to be stacked. The binding section 30 further includes a housing portion 32 which houses binders Pr, and a binding portion 33 which takes out the binder Pr from the housing portion 32, and passes the binder Pr through the holes Ph of a bundle of the sheets P1 stacked on the sheet registration tray 31, thereby binding the bundle of the sheets P1.

As the second process, in the binding portion 33, the binding section 30 passes the binder Pr through the holes Ph of the bundle of the sheets P1 stacked on the sheet registration tray 31, thereby producing the booklet P10. In the configuration where the binder $Pr_1$ shown in FIG. 3A is used, the binding section 30 moves the binder $Pr_1$ that is taken out from the housing portion 32 in which a plurality of binders $Pr_1$ are stored in a state (not shown) where the ring portions $Pr_{10}$ are opened, to the side under the end portion of the bundle of the sheets P1 that are aligned on the sheet registration tray 31, and, in the binding portion 33, then closes the ring portions $Pr_{10}$ so that the ring portions $Pr_{10}$ enter the holes Ph of the sheets P1, respectively.

In the configuration where the binder $Pr_2$ shown in FIG. 3B is used, in the binding portion 33, the binding section 30 feeds the binder $Pr_2$ that is taken out from the housing portion 32 in which a plurality of binders $Pr_2$ are housed, while rotating the binder, and inserts the binder into the holes Ph with starting from the side of one side edge of the bundle of the sheets P1.

The booklet conveying path 40 includes a first conveying belt 41 which receives the booklet P10 that is produced in the binding section 30, and a second conveying belt 42 which discharges the booklet P10 that is received by the first conveying belt 41, onto the booklet tray 50. The booklet conveying path 40 is configured so that the first conveying belt 41 is movable between a receiving position illustrated by the dash-dot line in FIG. 1, and a discharging position illustrated by the solid line.

The booklet conveying path 40 moves the first conveying belt 41 to the receiving position, and then receives the booklet P10 that is produced in the binding section 30, by using the first conveying belt 41. The booklet conveying path 40 moves the first conveying belt 41 which receives the booklet P10 to the discharging position, and then discharges the booklet P10 onto the booklet tray 50 by using the first conveying belt 41 and the second conveying belt 42.

The booklet tray 50 is an example of the second discharging section, disposed while being separated by a height which allows a plurality of booklets P10 to be stacked, from a discharging port 43 of the booklet conveying path 40, and does not include a mechanism for elevating the booklet tray 50.

<Example of Control Function of Book Binding System in this Embodiment>

Figure 4:
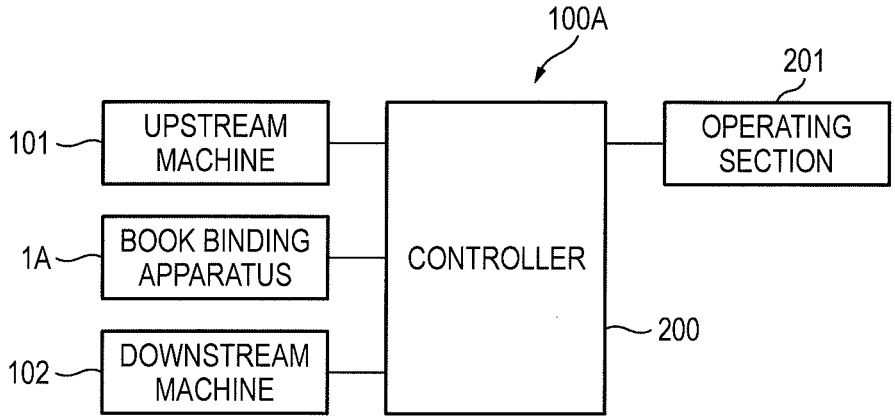
FIG. 4 is a block diagram showing an example of a control function of a book binding system in the embodiment.

FIG. 4 is a block diagram showing an example of a control function of the book binding system in the embodiment. In the case where the upstream machine 101 is an image forming apparatus, the book binding system 100A includes a controller 200 which performs the controls of supply of the sheet P1, image formation, and sheet discharge in the upstream machine 101, those of production of the booklet P10, and punching of holes in the sheet P1 and discharging of the sheet in the book binding apparatus 1A, and like controls. The controller 200 is an example of the controlling unit, and includes a microprocessor which is called a CPU or an MPU, and memories such as a RAM and a ROM.

The book binding system 100A further includes an operating section 201 that is an operating unit on which various operations, and selection of processes in the book binding apparatus 1A are performed. Processes which can be selected in the book binding apparatus 1A are a book binding process in which sheets P1 are bound with the binder Pr, and then output, a punching process in which holes are punched in the sheet P1, and then the sheet is output, and a through process in which no process is performed on the sheet P1, and the sheet is then output.

In the case where the upstream machine 101 is an image forming apparatus, the image forming apparatus may include a master CPU functioning as a controller, and the book binding apparatus 1A and the downstream machine 102 may include a slave CPU functioning as a controller which is controlled by the master CPU.

The controller 200 determines a discharge destination of the sheet P1 or the booklet P10 based on the process in the book binding apparatus 1A which is selected by a user operation on the operating section 201. When the book binding process is selected, the controller 200 causes the punching section 20 to punch the holes Ph in the sheet P1 output from the upstream machine 101, the binding section 30 to bind the sheets with the binder Pr, and the booklet conveying path 40 to discharge the bound sheets onto the booklet tray 50.

By contrast, when the punching process is selected, the controller 200 causes the punching section 20 to punch the holes Ph in the sheet P1 output from the upstream machine 101, the conveying direction of the sheet P1 in which the holes Ph are punched, to be reversed while not conveyed to the binding section 30, and the sheet to be discharged to the downstream machine 102. In the case where the downstream machine 102 is not connected, the sheet is discharged to the sheet discharging port lie of the book binding apparatus 1A.

The controller 200 further causes the user to select the process in the book binding apparatus 1A, and the discharge destination of the sheet P1 or the booklet P10 by means of the operating section 201, determines whether the sheet P1 or the booklet P10 can be discharged to the selected discharge destination or not, and further determines the discharge destination of the sheet P1 or the booklet P10.

Figure 5:
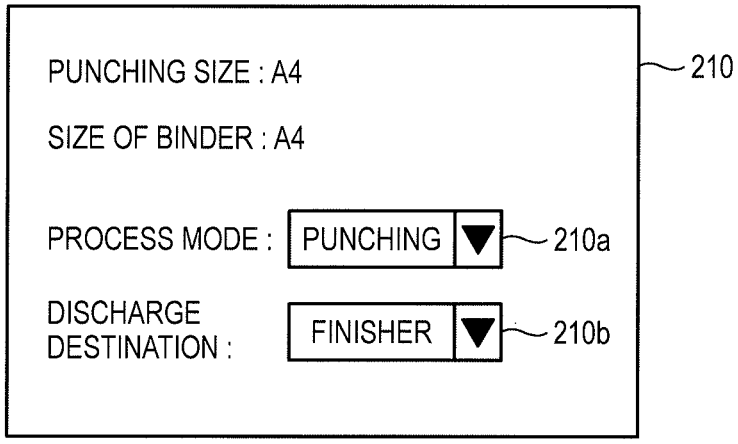
FIG. 5 is a view illustrating an example of an operation screen for selecting a process and discharge destination in the book binding apparatus.

FIG. 5 is a view illustrating an example of an operation screen for selecting a process and discharge destination in the book binding apparatus of the first embodiment, and FIG. 6 is a view illustrating the availability of combinations of the process and discharge destination in the book binding apparatus of the first embodiment. On an operation screen 210 shown in FIG. 5, a process mode selection button 210*a* for selecting the process in the book binding apparatus 1A, and a discharge destination selection button 210*b* for selecting the discharge destination are displayed. The process mode selection button 210*a* and the discharge destination selection button 210*b* are configured so that a desired process or discharge destination can be selected from, for example, a pull-down menu.

When the process in the book binding apparatus 1A is selected by operating the process mode selection button 210*a* on the operation screen 210, the controller 200 enables only discharge destinations which can be selected as the discharge destination, to be selected by operating the discharge destination selection button 210*b*, based on the combination available information shown in FIG. 6. In the case where the punching process is selected by operating the process mode selection button 210*a*, if the main conveying path 11 is normal, for example, the downstream machine 102 (the finisher) is made selectable as the discharge destination, and the booklet tray 50 is made unselectable. Alternatively, the booklet tray 50 may be changed to be selectable, based on booklet tray information indicating whether the booklet P10 is discharged onto the booklet tray 50 or not, conveying path information indicating whether the conveying paths are normal or not, etc. If the main conveying path 11 is abnormal, the process is disabled.

On the operation screen 210, the kind and size of the binder Pr, the size of the sheets P1 to be bound, and the like may be selectable. In this case, when the kind and size of the binder Pr which can be used in the book binding apparatus 1A are not coincident with the size of the sheets P1, and the binding process cannot be performed, the sheets P1 cannot be bound with the binder Pr, and therefore a warning indicating that the binding process cannot be performed is output on the operation screen 210. Since the sheets P1 cannot be discharged while being bound with the binder Pr, the booklet tray 50 is made unselectable as the discharge destination.

In the case where the binding process cannot be performed, but the punching process can be performed, by contrast, the punching process can be selected by operating the process mode selection button 210*a* on the operation screen 210, and the binding process is made unselectable. Moreover, the downstream machine 102 is made selectable as the discharge destination by the discharge destination selection button 210*b*, and the booklet tray 50 is made unselectable.

The case where the binding process cannot be performed includes a case where the binders Pr housed in the housing portion 32 of the binding section 30 are exhausted, that where the binding section 30, the booklet conveying path 40, and the booklet tray 50 break down, that where the booklet tray 50 is filled with the booklets P10, and the like.

<Operation Example of Book Binding Apparatus of First Embodiment>

Figure 7:
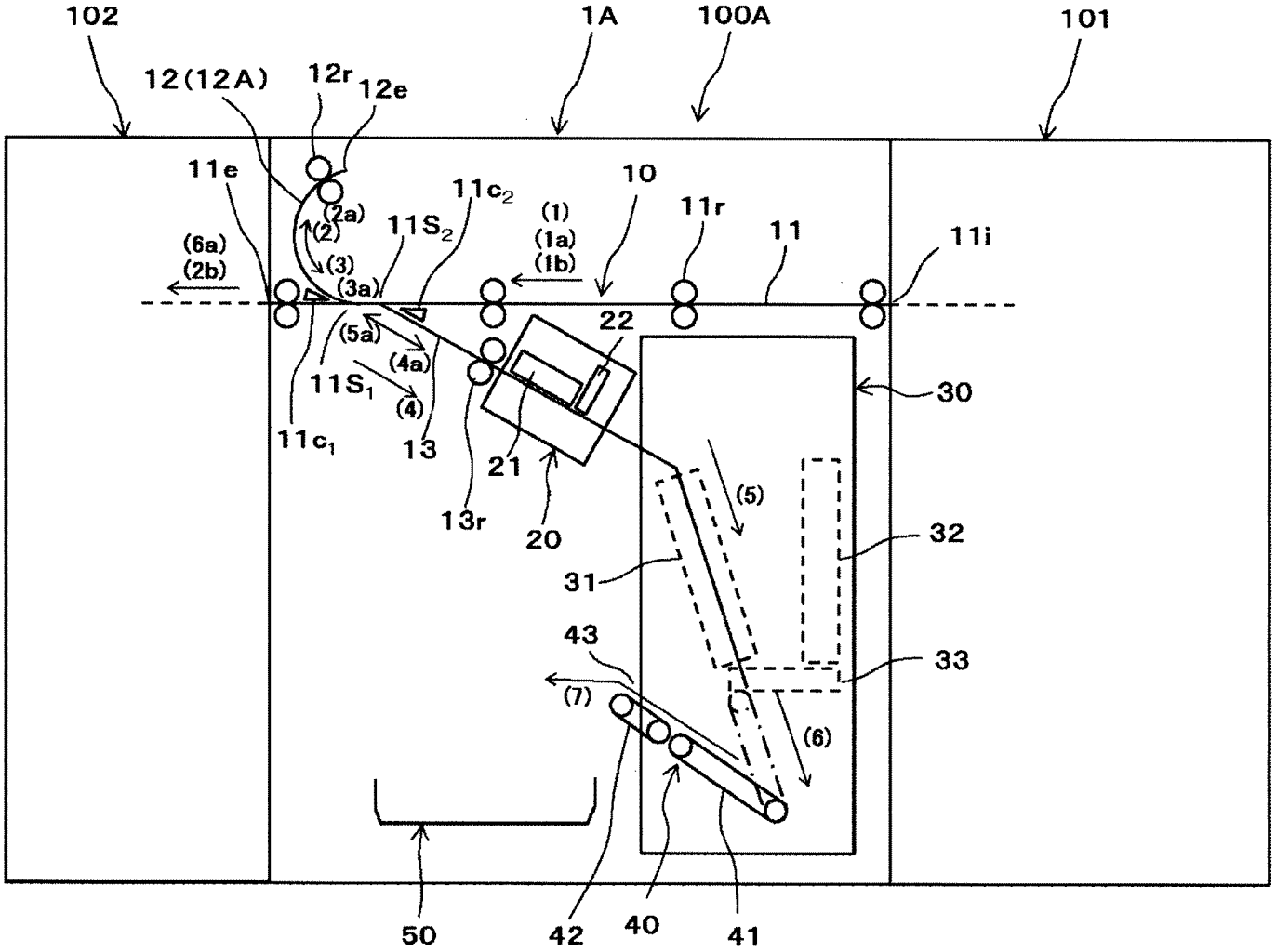
FIG. 7 is a view illustrating an operation example of the book binding apparatus of the first embodiment.

FIG. 7 is a view illustrating an operation example of the book binding apparatus of the first embodiment. First, an operation in the case where the book binding process is selected will be described. When the book binding process is selected, the booklet tray 50 is selected as the discharge destination from the combinations shown in FIG. 6.

When the book binding process is selected, and the booklet tray 50 is selected as the discharge destination, the conveying passage for the sheet P1 in the branch portion 11$S_1$ in the book binding apparatus 1A is switched to the reverse conveying path 12, and the sheet P1 output from the upstream machine 101 is conveyed through the main conveying path 11 as indicated by the arrow labeled by the reference numeral (1) in FIG. 7.

As indicated by the arrow labeled by the reference numeral (2) in FIG. 7, when the sheet P1 which is conveyed from the main conveying path 11 to the reverse conveying path 12 is conveyed to a predetermined position where the rear end of the sheet P1 passes the branch portion 11$S_2$, the conveyance of the sheet P1 is temporarily stopped, and the conveying passage for the sheet P1 in the branch portion 11$S_2$ is switched to the sub-conveying path 13.

When the conveying direction of the sheet P1 in the reverse conveying path 12 is reversed as indicated by the arrow labeled by the reference numeral (3) in FIG. 7, the sheet P1 is conveyed to the sub-conveying path 13 as indicated by the arrow labeled by the reference numeral (4) in FIG. 7. When the sheet P1 which is conveyed through the sub-conveying path 13 reaches the punching section 20, the conveyance of the sheet P1 is temporarily stopped, positional alignment is performed in the positioning portion 21, and then the holes Ph are opened by the punch blade 22.

The sheet P1 in which the holes Ph are opened in the punching section 20 is conveyed from the punching section 20 to the binding section 30 as indicated by the arrow labeled by the reference numeral (5) in FIG. 7. In the binding section 30, a plurality of sheets P1 in which the holes Ph are opened are aligned with one another and stacked on the sheet registration tray 31. When a predetermined number of sheets P1 are stacked, a bundle of the sheets P1 is bound in the binding portion 33 by using the binder Pr which is taken out from the housing portion 32.

The booklet P10 which is bound in the binding section 30 is conveyed to the booklet conveying path 40 in which the first conveying belt 41 is moved to the receiving position, as indicated by the arrow labeled by the reference numeral (6) in FIG. 7, and then discharged to the booklet tray 50 by the first conveying belt 41 which is moved to the discharging position, and the second conveying belt 42, as indicated by the arrow labeled by the reference numeral (7) in FIG. 7.

Then, an operation in the case where the punching process is selected will be described. When the punching process is selected, the downstream machine 102 (the finisher) is selected as the discharge destination from the combinations shown in FIG. 6. When the punching process is selected, and the downstream machine 102 (the finisher) is selected as the discharge destination, the conveying passage for the sheet P1 in the branch portion 11$S_1$ in the book binding apparatus 1A is switched to the reverse conveying path 12, and the sheet P1 output from the upstream machine 101 is conveyed through the main conveying path 11 as indicated by the arrow labeled by the reference numeral (1*a*) in FIG. 7.

As indicated by the arrow labeled by the reference numeral (2*a*) in FIG. 7, when the sheet P1 which is conveyed from the main conveying path 11 to the reverse conveying path 12 is conveyed to a predetermined position where the rear end of the sheet P1 passes the branch portion 11$S_2$, the conveyance of the sheet P1 is temporarily stopped, and the conveying passage for the sheet P1 in the branch portion 11$S_2$ is switched to the sub-conveying path 13.

When the conveying direction of the sheet P1 in the reverse conveying path 12 is reversed as indicated by the arrow labeled by the reference numeral (3*a*) in FIG. 7, the sheet P1 is conveyed to the sub-conveying path 13 as indicated by the arrow labeled by the reference numeral (4*a*) in FIG. 7. When the sheet P1 which is conveyed through the sub-conveying path 13 reaches the punching section 20, the conveyance of the sheet P1 is temporarily stopped, positional alignment is performed in the positioning portion 21, and then the holes Ph are opened by the punch blade 22.

The sheet P1 in which the holes Ph are opened in the punching section 20 is conveyed from the punching section 20 toward the main conveying path 11 as indicated by the arrow labeled by the reference numeral (5*a*) in FIG. 7, by reversing the conveying direction of the sheet P1 in the sub-conveying path 13. When the conveying passage for the sheet P1 in the branch portion 11$S_1$ is switched to the main conveying path 11, the sheet P1 in which the holes are opened is discharged to the downstream machine 102 as indicated by the arrow labeled by the reference numeral (6*a*) in FIG. 7.

Then, an operation in the case where the through process is selected will be described. When the through process is selected, the downstream machine 102 (the finisher) is selected as the discharge destination from the combinations shown in FIG. 6. When the through process is selected, and the downstream machine 102 (the finisher) is selected as the discharge destination, the conveying passage for the sheet P1 in the branch portion 11$S_1$ in the book binding apparatus 1A is switched to the main conveying path 11, and the sheet P1 output from the upstream machine 101 is conveyed through the main conveying path 11 as indicated by the arrow labeled by the reference numeral (1*b*) in FIG. 7. As indicated by the arrow labeled by the reference numeral (2*b*) in FIG. 7, the sheet P1 is then discharged to the downstream machine 102 without performing any further process in the book binding apparatus 1A.

<Example of Function and Effect of Book Binding Apparatus of First Embodiment>

In the book binding apparatus 1A of the first embodiment, in the punching process in which only the punching process is performed, the sheet P1 in which holes are opened is discharged to the downstream machine 102 in contrast to the book binding process in which the booklet P10 is discharged onto the booklet tray 50.

According to the configuration, the booklets P10 each of which is bound with the binder Pr, and the sheets P1 which are not bound with the binder Pr, and in which holes are opened can be prevented from mixedly existing on the booklet tray 50. Therefore, it is not necessary to sort the sheets P1 from the booklets P10 which are stacked on the booklet tray 50. Moreover, it is possible to suppress damage of the sheets P1 due to mixed stack of the sheets P1 and the booklets P10. As compared to the case where the booklets P10 and the sheets P1 are mixedly stacked, furthermore, it is possible to increase the number of stackable booklets P10 if the booklet tray 50 has the same size.

When functions of the downstream machine 102 are used, discharging of the sheets P1 while sorting the sheets P1, discharging of the sheets while performing alignment, and the like can be performed. Therefore, the convenience is improved without additionally providing functions relating to the sheets P1, such as sorting and alignment to the book binding apparatus 1A.

Since the sheets P1 are not discharged onto the booklet tray 50, a mechanism which elevates the booklet tray, and in which discharging of the sheets P1 is considered is not necessary, and therefore the configuration of the booklet tray 50 can be simplified. The configuration where a mechanism for elevating the booklet tray is not necessary enables the length of the booklet conveying path 40 to be shortened. In a configuration where the sheets P1 are discharged onto the booklet tray 50, the conveying speed is lowered in consideration of damage of the sheets P1. When only the booklets P10 are discharged onto the booklet tray 50, however, it is not required to lower the conveying speed. Therefore, the length of the booklet conveying path 40 can be shortened, it is not necessary to lower the conveying speed, and the booklet tray is not required to be lifted up or down, with the result that the process time period can be shortened. Since the length of the booklet conveying path 40 can be shortened, moreover, the size of the apparatus can be reduced.

In relation to the size reduction of the apparatus, in a conventional configuration where the conveying direction of the sheet P1 conveyed through the main conveying path 11 is reversed to be sent to the sub-conveying path 13, and a portion of the main conveying path 11 which is downstream from the branch portion 11$S_1$ is used as a reverse conveying path, the length between the branch portion 11$S_1$ and the sheet discharging port 11*e* must be equal to or longer than the conveying length of the sheet P1.

By contrast, the apparatus includes the reverse conveying path 12 which branches from the main conveying path 11, and the reverse conveying path 12 is configured by a curved conveying path 12A constituting the curved conveying passage. Therefore, the length between the branch portion 11$S_1$ and the sheet discharging port 11*e* can be shorter than the length of the sheet P1 in the conveying direction. As a result, the size of the apparatus can be reduced.

<Configuration Example of book binding apparatus of Second Embodiment>

Figure 8:
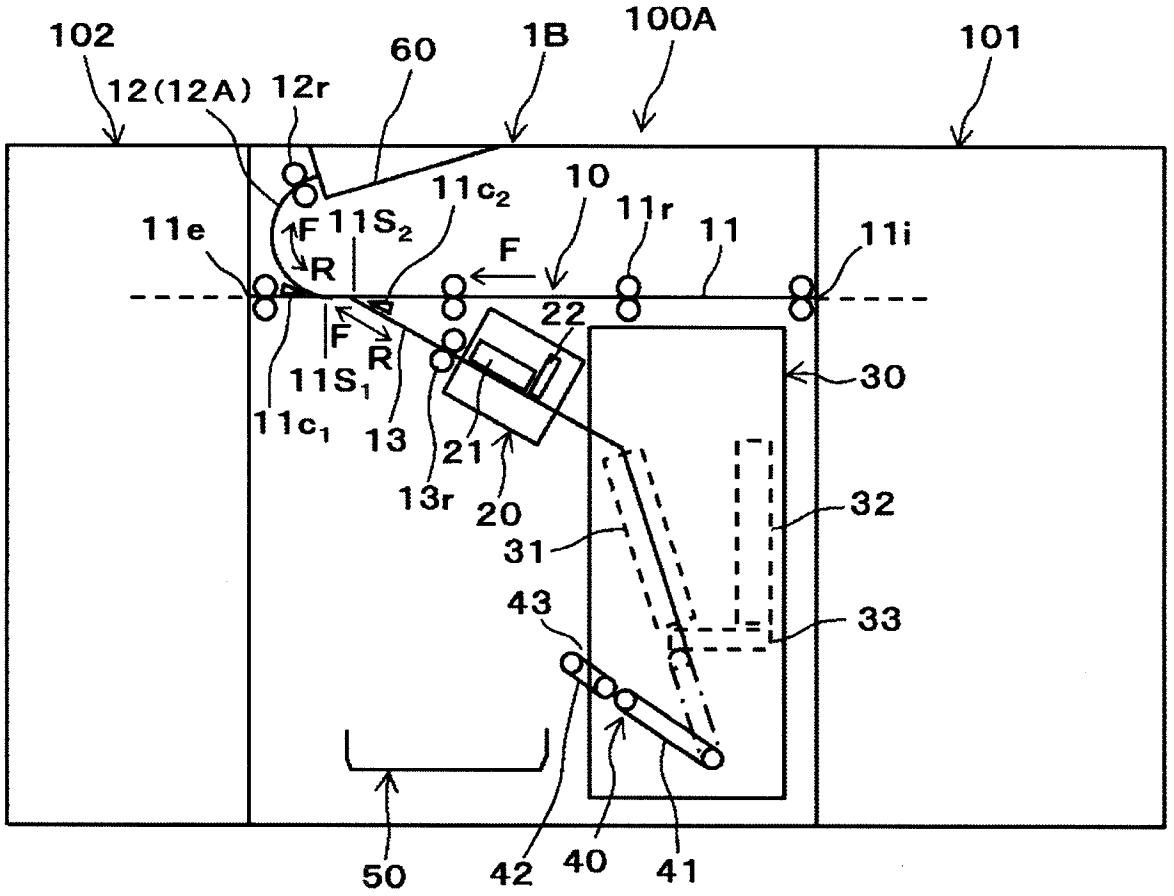
FIG. 8 is a diagram showing an example of a book binding apparatus of a second embodiment.

FIG. 8 is a diagram showing an example of a book binding apparatus of a second embodiment. The book binding apparatus 1B of the second embodiment includes an upper tray (a third discharging section) 60 in the terminal end of the reverse conveying path 12. The upper tray 60 is an example of the third discharging section, and disposed on the upper surface of the book binding apparatus 1B. The sheet P1 which is conveyed through the reverse conveying path 12 can be discharged onto the upper tray. In the book binding apparatus 1B, the configuration other than the upper tray 60 is identical with that of the book binding apparatus 1A of the first embodiment. Therefore, the components are denoted by the same reference numerals, and their description is omitted.

<Operation Example of Book Binding Apparatus of Second Embodiment>

Figure 10:
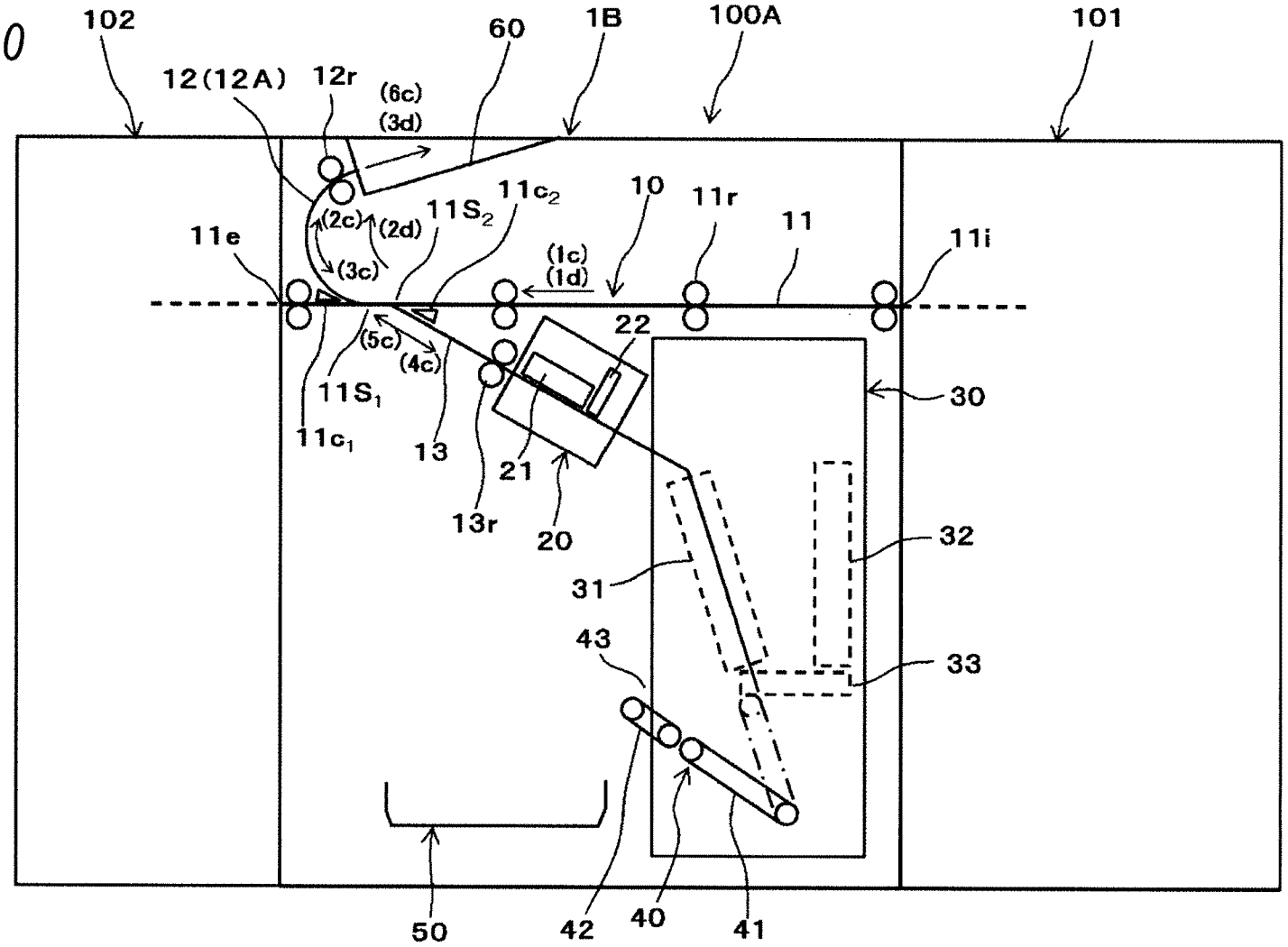
FIG. 10 is a view illustrating an operation example of the book binding apparatus of the second embodiment.

FIG. 9 is a view illustrating the availability of combinations of the process and discharge destination in the book binding apparatus of the second embodiment, and FIG. 10 is a view illustrating an example of operations of the book binding apparatus of the second embodiment. In the book binding apparatus 1B of the second embodiment, the process in the case where the upper tray 60 is not selected as the discharge destination is identical with the operations which have been described with reference to FIG. 7.

In the book binding apparatus 1B, when the book binding process is selected, the upper tray 60 cannot be selected as the discharge destination. When the punching process or the through process is selected, the upper tray 60 can be selected as the discharge destination.

FIG. 10 shows operations in the case where the punching process is selected, and the upper tray 60 is selected as the discharge destination. When the punching process is selected, and the upper tray 60 is selected as the discharge destination, the conveying passage for the sheet P1 in the branch portion 11$S_1$ in the book binding apparatus 1B is switched to the reverse conveying path 12, and the sheet P1 output from the upstream machine 101 is conveyed through the main conveying path 11 as indicated by the arrow labeled by the reference numeral (1*c*) in FIG. 10.

As indicated by the arrow labeled by the reference numeral (2*c*) in FIG. 10, when the sheet P1 which is conveyed from the main conveying path 11 to the reverse conveying path 12 is conveyed to a predetermined position where the rear end of the sheet P1 passes the branch portion 11$S_2$, the conveyance of the sheet P1 is temporarily stopped, and the conveying passage for the sheet P1 in the branch portion 11$S_2$ is switched to the sub-conveying path 13.

When the conveying direction of the sheet P1 in the reverse conveying path 12 is reversed as indicated by the arrow labeled by the reference numeral (3*c*) in FIG. 10, the sheet P1 is conveyed to the sub-conveying path 13 as indicated by the arrow labeled by the reference numeral (4*c*) in FIG. 10. When the sheet P1 which is conveyed through the sub-conveying path 13 reaches the punching section 20, the conveyance of the sheet P1 is temporarily stopped, positional alignment is performed in the positioning portion 21, and then the holes Ph are opened by the punch blade 22.

When the conveying direction of the sheet P1 in the sub-conveying path 13 is reversed, the sheet P1 in which the holes Ph are opened in the punching section 20 is conveyed from the punching section 20 to the main conveying path 11 as indicated by the arrow labeled by the reference numeral (5*c*) in FIG. 10. Then, the sheet P1 is conveyed from the main conveying path 11 to the reverse conveying path 12, and the sheet P1 in which the holes are opened is discharged onto the upper tray 60 as indicated by the arrow labeled by the reference numeral (6*c*) in FIG. 10.

Then, an operation in the case where the through process is selected, and the upper tray 60 is selected as the discharge destination will be described. When the through process is selected, and the upper tray 60 is selected as the discharge destination, the conveying passage for the sheet P1 in the branch portion 11$S_1$ in the book binding apparatus 1B is switched to the reverse conveying path 12, and the sheet P1 output from the upstream machine 101 is conveyed through the main conveying path 11 as indicated by the arrow labeled by the reference numeral (1*d*) in FIG. 10.

The sheet P1 which is conveyed through the main conveying path 11 is conveyed to the reverse conveying path 12 as indicated by the arrow labeled by the reference numeral (2*d*) in FIG. 10, and then discharged onto the upper tray 60 without performing any further process in the book binding apparatus 1B as indicated by the arrow labeled by the reference numeral (3*d*) in FIG. 10.

<Example of Function and Effect of Book Binding Apparatus of Second Embodiment>

The book binding apparatus 1B of the second embodiment includes the upper tray 60 which enables discharging of the sheet P1 in the punching process and the through process to be performed, and therefore the number of sheets P1 which can be discharged can be increased in the whole book binding system 100A.

Moreover, either one of the downstream machine 102 and the upper tray 60 can be selected as the discharge destination of the sheet P1 which does not undergo the book binding process. Since options of the discharge destination of the sheet P1 are increased, for example, the discharge destination can be changed in units of job. Therefore, the convenience of sorting is improved. Even in the case where the downstream machine 102 fails, furthermore, the sheet P1 can be discharged onto the upper tray 60, and therefore it is possible to suppress the process stop due to system down.

In a configuration in which the downstream machine 102 is not connected, furthermore, it is not necessary to dispose a discharge tray on the side surface of the book binding apparatus 1B, and therefore the installation space can be reduced. Although, in the first and second embodiments, the examples in which the punching section 20 is disposed in the sub-conveying path 13 have been described, the disclosure is not limited to them. The punching section 20 may be disposed in a portion of the main conveying path 11 which is upstream from the branch portion 11$S_1$.

In the disclosure, media which undergo the first process, and those which undergo the first process and the second process are discharged to the different discharging sections, and therefore it is possible to prevent media that are differently processed, from being mixedly stacked.

Accordingly, the second discharging section is not required to have a configuration in which discharging of media that undergo only the first process is considered, and can be configured so as to be suitable to discharging of media that undergo the first process and the second process.

The present disclosure relates to a book binding apparatus which can perform a plurality of different processes on media.

What is claimed is:

1. A book binding apparatus comprising:

a first processing section which is configured to perform a first process on a medium;

a second processing section which is configured to perform a second process on the medium on which the first processing section has performed the first process;

a first discharging section to which the medium on which the first processing section has performed the first process is discharged;

a second discharging section to which the medium on which the first processing section has performed the first process, and on which the second processing section has performed the second process is discharged;

a main conveying path which is configured to convey the medium;

a reverse conveying path which branches from the main conveying path, and which is configured to reverse a conveying direction of the medium, wherein a first branch portion connects the reverse conveying path and the main conveying path; and a sub-conveying path which branches from the main conveying path, and which is configured to convey the medium in a conveying direction different from the reverse conveying path, wherein a second branch portion connects the sub-conveying path to the main conveying path;

wherein:

the first processing section is disposed along one of the main conveying path or the sub-conveying path, the second processing section is disposed along the sub-conveying path, the first discharging section is disposed on a downstream side of the main conveying path, and the second discharging section is disposed on a downstream side of the sub-conveying path.

2. The book binding apparatus according to claim 1, further comprising a third discharging section in a terminal end of the reverse conveying path.

3. The book binding apparatus according to claim 1, wherein the reverse conveying path includes a curved conveying path in which a conveying passage has a curved shape.

4. The book binding apparatus according to claim 1, wherein the first processing section is a punching section which is configured to punch a hole in the medium, and the second processing section is a binding section which is configured to pass a binder through the hole that is punched by the punching section.

5. The book binding apparatus according to claim 1, further comprising a controller which is configured to cause an operation to be performed for selecting one of processes of:

discharging the medium on which the first processing section has performed the first process, to the first discharging section; or performing the second process by the second processing section on the medium on which the first processing section has performed the first process, and then discharging the medium to the second discharging section.

6. The book binding apparatus according to claim 2, further comprising a controller which is configured to cause an operation to be performed for selecting one of processes of:

discharging the medium on which the first processing section has performed the first process, to the first discharging section;

performing the second process by the second processing section on the medium on which the first processing section has performed the first process, and then discharging the medium to the second discharging section; or discharging the medium on which the first processing section has performed the first process, to the third discharging section.

7. The book binding apparatus according to claim 1, wherein the second branch portion is disposed along the main conveying path at a location upstream from the first branch portion.

8. The book binding apparatus according to claim 7, wherein the reverse conveying path extends above the main conveying path and the sub-conveying path extends below the main conveying path.

9. The book binding apparatus according to claim 1, wherein the reverse conveying path extends above the main conveying path and the sub-conveying path extends below the main conveying path.

10. The book binding apparatus according to claim 1, wherein the first processing section is disposed along the sub-conveying path, and wherein the apparatus further includes a controller configured to control conveyance of the medium along the main conveying path and the sub-conveying path such that:

(i) medium which is processed by the first processing section but not the second processing section is conveyed from the main conveying path to the sub-conveying path and to the first processing section, and after processing in the first processing section, the medium is conveyed along the sub-conveying path back to the main conveying path and then conveyed to the first discharging section; and (ii) medium which is processed by both the first processing section and the second processing section is conveyed from the main conveying path to the sub-conveying path and to first processing section, and after processing in the first processing section, the medium is conveyed along the sub-conveying path to the second processing section, and after processing in the second processing section, the medium is conveyed along the sub-conveying path to the second discharging section.

11. A book binding apparatus comprising:

a first processing section which is configured to perform a first process;

a second processing section which is configured to perform a second process;

a first discharging section; and a second discharging section, wherein, in a first process mode, the first process is performed by the first processing section on a medium, and the medium on which the first process has been performed by the first processing section is discharged to the first discharging section, in a second process mode, the first process is performed by the first processing section on a medium, the second process is performed by the second processing section on the medium on which the first process has been performed, and the medium on which the first process and the second process have been performed is discharged to the second discharging section, and the first process mode and the second process mode are selectively executed;

the apparatus further comprising:

a main conveying path which is configured to convey the medium;

a reverse conveying path which branches from the main conveying path, and which is configured to reverse a conveying direction of the medium, wherein a first branch portion connects the reverse conveying path and the main conveying path; and a sub-conveying path which branches from the main conveying path, and which is configured to convey the medium in a conveying direction different from the reverse conveying path, wherein a second branch portion connects the sub-conveying path to the main conveying path;

wherein:

the first processing section is disposed along one of the main conveying path or the sub-conveying path, the second processing section is disposed along the sub-conveying path, the first discharging section is disposed on a downstream side of the main conveying path, and the second discharging section is disposed on a downstream side of the sub-conveying path.

12. The book binding apparatus according to claim 11, wherein the second branch portion is disposed along the main conveying path at a location upstream from the first branch portion.

13. The book binding apparatus according to claim 12, wherein the reverse conveying path extends above the main conveying path and the sub-conveying path extends below the main conveying path.

14. The book binding apparatus according to claim 11, wherein the reverse conveying path extends above the main conveying path and the sub-conveying path extends below the main conveying path.

15. The book binding apparatus according to claim 11, wherein the first processing section is disposed along the sub-conveying path, and wherein the apparatus further includes a controller configured to control conveyance of the medium along the main conveying path and the sub-conveying path such that:

(i) medium which is processed by the first processing section but not the second processing section is conveyed from the main conveying path to the sub-conveying path and to the first processing section, and after processing in the first processing section, the medium is conveyed along the sub-conveying path back to the main conveying path and then conveyed to the first discharging section; and (ii) medium which is processed by both the first processing section and the second processing section is conveyed from the main conveying path to the sub-conveying path and to first processing section, and after processing in the first processing section, the medium is conveyed along the sub-conveying path to the second processing section, and after processing in the second processing section, the medium is conveyed along the sub-conveying path to the second discharging section.

* * * * *